US006800599B2

(12) United States Patent
Manske

(10) Patent No.: US 6,800,599 B2
(45) Date of Patent: Oct. 5, 2004

(54) LIQUID HAND DISHWASHING DETERGENT

(75) Inventor: Scott D. Manske, Davidson, NC (US)

(73) Assignee: Clariant Finance (BVI) Limited, Tortola (VG)

( * ) Notice: Subject to any disclaimer, the term of this patent is extended or adjusted under 35 U.S.C. 154(b) by 109 days.

(21) Appl. No.: 10/152,445

(22) Filed: May 21, 2002

(65) Prior Publication Data

US 2003/0220215 A1 Nov. 27, 2003

(51) Int. Cl.[7] ..... C11D 1/02; C11D 1/68; C11D 1/83; B08B 3/04

(52) U.S. Cl. ..... 510/228; 510/235; 510/425; 510/428; 510/475; 510/492; 510/535; 134/25.2; 134/25.3; 134/39; 134/42

(58) Field of Search ..... 510/228, 235, 510/425, 428, 475, 492, 535; 134/25.2, 25.3, 39, 42

(56) References Cited

U.S. PATENT DOCUMENTS 3,963,649 A 6/1976 Spadini et al. ..... 252/546
4,797,231 A 1/1989 Schumann et al. ..... 252/547
5,696,073 A 12/1997 Jakubicki et al.
5,700,773 A 12/1997 Jakubicki et al.
5,834,417 A 11/1998 Zyzyck et al.
5,853,743 A 12/1998 Gambogi et al.
5,854,195 A 12/1998 Jakubicki et al.
5,856,293 A 1/1999 Gambogi et al.
5,955,411 A 9/1999 Gorlin
5,968,890 A 10/1999 Chambers et al.
5,998,355 A 12/1999 Brumbaugh
6,251,844 B1 * 6/2001 Leonard et al. ..... 510/238
6,268,330 B1 * 7/2001 Leonard et al. ..... 510/417
6,339,057 B1 1/2002 Knox et al.
6,444,636 B1 9/2002 Toussaint et al. ..... 510/426

* cited by examiner

*Primary Examiner*—Brian P. Mruk
(74) *Attorney, Agent, or Firm*—Richard P. Silverman

(57) ABSTRACT

The invention relates to a class of detergent compositions for use in hand dishwashing that provides excellent performance as measured by persistence of foam in the presence of oily and fatty types of soils. Testing based on escalating amounts of such soils to the extinction of the foam showed surprising advantage of hand dishwashing composition comprising at least two anionic surfactants and a polyethylene glycol and being essentially free of alkyl polyglucosides.

24 Claims, No Drawings

LIQUID HAND DISHWASHING DETERGENT

FIELD OF INVENTION

The present invention relates to a liquid detergent formulation for the hand washing of dishes. More particularly, the present invention relates to a detergent formulation for the hand washing of dishes where the persistence of foam in the presence of oily, fatty types of soils is critical to the performance of the detergent.

BACKGROUND OF INVENTION

Liquid hand dishwashing detergent or alternatively referred to as light-duty liquid detergent (LDL) formulations for the cleaning of kitchen surfaces are well known. Kitchen surfaces include counter tops, stove tops, dishes and any other hard surface commonly found in kitchen environments. The term "dishes" includes any utensils involved in food preparation or consumption. Kitchen surfaces, particularly dishes, must be washed free of food residues, greases, proteins, starches, gums, dyes, oils and burnt organic residues. As the term "hand dishwashing" implies, the products typically come into contact with both these hard surfaces to be cleaned and the skin of the person using the product.

Most of the consumer accepted formulations for cleaning dishes with hand dishwashing detergents include anionic surfactants as the primary cleaning ingredients and mildness enhancing, foam stabilizing surfactants such as amine oxides, betaines, and alkanolamides as the secondary surfactants. A significant number of formulations will also include conventional nonionic surfactants (e.g. alcohol ethoxylate, alkyl phenol ethoxylate) and/or specialty nonionic surfactants (i.e. alkyl polyglucoside) to provide the benefits of a mixed active system.

The anionic surfactants in such formulations generally provide the typical high foaming characteristics associated with dishwashing formulations. The foam stabilizing surfactants typically provide the formulation with enhanced product mildness to contacted skin during hand dishwashing and enhanced performance robustness to higher water hardness and to removed soil. This enhanced product performance robustness is typically shown by high levels of foam over a wide range of water hardness levels combined with extended foam persistence during the washing process as more and more soils are deterged into the wash solution.

Foam persistence in the presence of increasing amounts of removed soils throughout the washing session is arguably the most important cleaning efficacy signal relied on by consumers. The hand dishwashing detergent industry uses the laboratory Miniplate Test as the key laboratory appraisal method for assessing this most important performance criterion and to quantify the performance quality of liquid hand dishwashing detergent formulations.

U.S. Pat. No. 5,968,890 B1 discloses a liquid detergent composition for cleansing the skin and hair and comprising a synthetic anionic surfactant, and an amphoteric surfactant and a polyethylene glycol for improved lather.

U.S. Pat. No. 6,268,330 B1 discloses an acidic light duty liquid detergent which is mild to the skin which can be in the form of a clear microemulsion and comprises a sulfate and a sulfonate anionic surfactant and a hydroxy aliphatic acid.

U.S. Pat. No. 6,251,844 B1 discloses an acidic light duty detergent with desirable high foaming and cleaning properties which kills bacteria and is mild to the skin. The light duty liquid detergent comprises an anionic surfactant, zwitterionic surfactant, polyethylene glycol, and a hydroxy acid. The anionic surfactant is present from 10–52 wt-% as a mixture of an alkali metal salt of an anionic sulfonate surfactant and an alkali metal salt of a $C_8$–$C_{18}$ ethoxylated alkyl ether sulfate or $C_8$–$C_{18}$ alkyl ether sulfate having a weight ratio of sulfonate surfactant to sulfate surfactant of 20 to 1:1. The zwitterionic surfactant is a water soluble betaine. The light duty liquid detergent further requires a magnesium salt as an essential ingredient to improve overall product performance.

U.S. Pat. No. 6,339,057 B1 discloses a high foaming detergent formulation having a non-ionic base. The reference points out a problem of incompatibility between anionic surfactants and cationic quaternary antimicrobial and the problem that non-ionic surfactants do not normally provide significant foaming capability to liquid formulations.

U.S. Pat. No. 5,955,411 discloses a high foaming light duty liquid detergent having antibacterial properties containing alkyl polyglucoside and polyethylene glycol in order to improve the viscosity of the detergent composition and to improve the flash foam point of the composition.

U.S. Pat. Nos. 5,696,073 B1, 5,700,773 B1, 5,834,417 B1, 5,853,743 B1, 5,854,195 B1, and 5,856,293 B1 disclose a series of light duty liquid cleaning compositions comprising anionic surfactants, specialty co-surfactants, polyethylene glycol, inorganic salts, hydrotroping agents, and an alkyl polyglucoside surfactant, wherein the alkyl polyglucoside is incorporated to provide mildness to human skin.

U.S. Pat. No. 5,998,355 B1 discloses a liquid dishwashing detergent that exhibits increased viscosity, better dissolution rate, and improved cleaning performance in hard water. The liquid dishwashing detergent comprises from about 1 to 90 percent of an anionic surfactant and from about 1 to 30 percent of a solvent hydrotrope selected from the group consisting of alkoxylated glycerides, alkoxylated glycerines, esters of alkoxylated glycerines, alkoxylated fatty acids, esters of glycerine, polyglycerol esters and combinations thereof.

It is an objective of the present invention to provide a light duty liquid detergent which provides improved detergency in hard water and in the presence of oily and fatty types of soils.

It is an objective to produce a light duty liquid detergent which exhibits foam persistence in the presence of oily and fatty types of soils.

It is an objective of the present invention to provide an improved light duty liquid detergent at a lower cost by eliminating exotic materials such as alkyl polyglucoside (APG) surfactants.

SUMMARY OF THE INVENTION

The invention relates to a class of compositions for use in light duty liquid, or liquid hand dishwashing detergents which provide excellent performance as measured by persistence of foam in the presence of oily and fatty types of soils. Testing of product performance—based on the stability of foam in the presence of escalating amounts of fatty or oily soils as indicated by the extinction of the foam—showed surprising advantage of the hand dishwashing detergent composition which is essentially free of alkyl polyglucoside, wherein the hand dishwashing detergent comprises at least two different anionic surfactants and a polyethylene glycol.

In one embodiment, the present invention is a liquid dishwashing detergent composition which comprises water, an anionic surfactant mixture containing at least two different anionic surfactants, a polyethylene glycol, and a hydrotrope and/or an inorganic magnesium salt, wherein the liquid dishwashing detergent is essentially free of alkyl polyglucoside (APG) surfactants. The formulation includes a phase stabilizer selected from the group consisting of a hydrotrope, an inorganic salt, and mixtures thereof. The polyethylene glycol employed in the dishwashing detergent formulation of the present invention comprises from about 0.5 to 10 weight percent of the dishwashing detergent and has a molecular weight ranging from about 400 to about 1000.

In another embodiment, the liquid dishwashing detergent consists essentially of: water;

about 5 to 30% by weight of an anionic surfactant;

about 5 to 30% by weight of a co-anionic surfactant;

about 0.5 to 10% by weight of polyethylene glycol;

about 0 to 15% by weight of a foam stabilizing surfactant; and, about 0 to 15% by weight of optional ingredients;

wherein the polyethylene glycol has a molecular weight ranging from about 400 to about 1000, with the proviso that the liquid dishwashing detergent be essentially free of alkyl polyglucosides. The optional ingredients are selected from the group consisting of hydrotropes, perfumes, colorants, pH adjusting agents, opacifiers, biocidal agents, preservatives, inorganic salts, viscosity modifiers, and mixtures thereof.

DETAILED DESCRIPTION OF THE INVENTION

Applicant discovered that the combination of at least two different anionic surfactants, a foam stabilizing surfactant, and polyethylene glycol resulted in surprisingly improved detergency performance, as measured by the well-known mini-plate test in water of varying hardness, than would have been predicted by just the addition of polyethylene glycol to liquid anionic dish washing detergent formulations with a single anionic surfactant either with or without a foam stabilizing surfactant. The instant invention is characterized in that the formulation of the present invention contains essentially no alkyl polyglucosides. By the term essentially no alkyl polyglucosides, it is meant that the dishwashing detergent contains less than about 0.005 weight percent alkyl polyglucosides. By the term alkyl polyglucosides as used herein, alkyl polyglucosides or alkyl polyglucoside surfactants include alkyl polysaccharides, alkyl monosaccharides and admixtures thereof. Examples include: $C_5$–$C_{17}$ acyl-N—($C_1$–$C_4$ alkyl) and —N—($C_1$–$C_2$ hydroxyalkyl) glucamine sulfates, and sulfates of alkyl polysaccharides, such as sulfates of alkyl polyglucoside. The characterization of alkyl polyglucosides as disclosed in U.S. Pat. Nos. 5,834,417 B1 , 5,853,743 B1, and 5,854,195 B1 are hereby incorporated by reference.

Anionic Surfactants

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic sulfate surfactants suitable for use in the compositions of the invention include linear and branched primary and secondary alkyl sulfates, alkyl ethoxysulfates, fatty oleoyl glycerol sulfates, and alkyl phenol ethylene oxide ether sulfates.

Suitable anionic carboxylate surfactants include alkyl ethoxy carboxylates, alkyl polyethoxy polycarboxylate surfactants and soaps ("alkyl carboxyls").

An example of a preferred anionic surfactant would be the sodium salt of secondary alkane sulfonate commercially available under the tradename of Hostapur® SAS (Clariant Corporation, Charlotte, N.C.).

Polyethylene Glycol

It was discovered that the molecular weight of the polyethylene glycol had a significant impact on the detergent performance. Polyethylene glycols having a molecular weight ranging between about 400 and about 1000 provided the greatest benefit. The polyethylene glycol used in the instant composition has a molecular weight of 200 to 1,500, wherein the polyethylene glycol has the structure $$HO(CH_2CH_2O)_n—H$$

wherein n is 4 to 25. The concentration of the polyethylene glycol in the instant composition is 0.5 to 10 wt. %, more preferably 0.75 wt. % to 6 wt. %. Preferably, the molecular weight of the polyethylene glycol ranges from about 400 to about 1500, more preferably, the molecular weight of the polyethylene glycol ranges between about 400 and about 1000, and most preferably, the molecular weight of the polyethylene glycol ranges between about 400 and about 800.

Water

The final ingredient in the inventive compositions is water. The proportion of water in the compositions generally is in the range of 35% to 85%, preferably 50% to 80% by weight of the usual composition.

Amine Oxide

Amine oxides useful in the present invention include long-chain alkyl amine oxides, ie., those compounds having the formula $$R^3(OR^4)_x—(NO)—(R^5)_2$$

wherein $R^3$ is selected from an alkyl, hydroxyalkyl, acylamidopropyl and alkyl phenyl group, or mixtures thereof, containing from 8 to 26 carbon atoms, preferably 8 to 16 carbon atoms; $R^4$ is an alkylene or hydroxyalkylene group containing from 2 to 3 carbon atoms, preferably 2 carbon atoms, or mixtures thereof; x is from 0 to 3, preferably 0; and each $R^5$ is an alkyl or hydroxyalkyl group containing from 1 to 3, preferably from 1 to 2 carbon atoms, or a polyethylene oxide group containing from 1 to 3, preferably 1, ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxyethyl amine oxides and alkyl amido propyl amine oxide. Examples of such materials include dimethyloctylamine oxide, diethyldecylamine oxide, bis-(2-hydroxyethyl)dodecylamine oxide, dimethyldodecylamine oxide, dodecylamidopropyl dimethylamine oxide and dimethyl-2-hydroxyoctadecylamine oxide. Preferred are $C_{10}$–$C_{18}$ alkyl dimethylamine oxide, and $C_{10}$–$C_{18}$ acylamido alkyl dimethylamine oxide.

Betaine

The betaines useful in the present invention are those compounds having the formula $R(R^1)_2\ N^+\ R^2\ COO^-$ wherein R is a $C_6$–$C_{18}$ hydrocarbyl group, preferably $C_{10}$–$C_{16}$ alkyl group, each $R^1$ is typically $C_1$–$C_3$, alkyl, preferably methyl, and $R^2$ is a $C_1$–$C_5$ hydrocarbyl group, preferably a $C_1$–$C_5$ alkylene group, more preferably a $C_1$–$C_2$ alkylene group. Examples of suitable betaines include coconut acylamidopropyldimethyl betaine; hexadecyl dimethyl betaine; $C_{12}$–$C_{14}$ acylamidopropylbetaine; $C_{12}$–$C_{18}$ acylamidohexyldiethyl betaine; 4-[$C_{14}$–$C_{16}$ acylmethylamidodiethylammonio]-1-carboxybutane; $C_{16}$–$C_{18}$ acylamidodimethylbetaine; $C_{12}$–$C_{16}$ acylamidopentanediethyl-betaine; $C_{12}$–$C_{16}$ acylmethylamidodimethylbetaine, and coco amidopropyl betaine. Preferred betaines are $C_{12}$–$C_{18}$ dimethylamoniohexanoate and the $C_{10}$–$C_{18}$ acylamidopropane (or ethane) dimethyl (or diethyl) betaines. Also included are sulfobetaines (sultaines) of formula $R(R_1)_2$ $N+R_2$ $SO_3$—, wherein R is a $C_6$–$C_{18}$ Hydrocarbyl group, preferably a $C_{10}$–$C_{16}$ alkyl group, more preferably a $C_{12}$–$C_{13}$ alkyl group; each $R_1$ is typically $C_1$–$C_3$ alkyl, preferably methyl and $R_2$ is a $C_1$–$C_6$ hydrocarbyl group, preferably a $C_1$–$C_3$ alkylene or, preferably, hydroxyalkylene group. Examples of suitable sultaines are $C_{12}$–$C_{14}$ dihydroxyethylammonio propane sulfonate, and C.sub.$_{16}$–C.sub.$_{18}$ dimethylammonio hexane sulfonate, with $C_{12}$–$C_{14}$ amido propyl ammonio-2-hydroxypropyl sultaine being preferred.

Alkanolamide Compounds

The present formulation can include an alkanolamide compound such as an alkyl monoalkanol amide, an alkyl dialkanol amide, and mixtures thereof.

Hydrotrope

The formulation of the present invention can include a hydrotrope selected from the group consisting of ethanol, isopropanol, sodium xylene sulfonate, propylene glycol, dipropylene glycol, sodium cumene sulfonate and mixtures thereof.

Inorganic Salt

The formulation of the present invention can include an inorganic or organic salt or oxide of a multivalent cation, particularly $Mg^{++}$ which has phase stabilization properties. The multivalent cation salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been reported with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent cation from which the salts (inclusive of the oxide and hydroxide) are formed, other polyvalent metal ions also can be used provided that their salts are nontoxic and are soluble in the aqueous phase of the system at the desired pH level.

The liquid cleaning composition of this invention may, if desired, also contain other optional components either to provide additional effect or to make the product more attractive to the consumer. The following are mentioned by way of example: Colorants or dyes in amounts up to 0.5% by weight; preservatives or antioxidizing agents, such as formalin, 5-bromo-5-nitro-dioxan-1,3; 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added. Preferably, the optional ingredients are selected from the group consisting of hydrotropes, perfumes, colorants, pH adjusting agents, preservatives, biocidal agents, inorganic salts, opacifiers, viscosity modifiers, and mixtures thereof In the present formulation, it was discovered that certain parameters were required to achieve the benefits of the invention. The total surfactant level in the detergent formulation includes all surfactants in the detergent for example, the anionics, any non-ionic and any amphoteric surfactants. The polyethylene glycol (PEG) is not considered a surfactant. Preferably, the hand dishwashing composition will comprise from about 15 to about 60 weight percent total surfactant, more preferably the hand dishwashing detergent comprises from about 20 to about 50 weight percent total surfactant, and most preferably, the hand dishwashing detergent comprises from about 20 to about 40 weight percent total surfactant. More particularly, the ratio of the first anionic surfactant to the second anionic surfactant comprises between about 0.5 and less than 1.0. The ratio of the foam stabilizing surfactant to the anionic surfactant mixture should comprise about 1:2 or less.

In the instant invention, detergent formulations were sought which comprised anionic surfactants that provide persistence of foam in the presence of oily and fatty types of soils. Testing of product performance—based on the stability of foam in the presence of escalating amounts of fatty or oily soils as indicated by the extinction of the foam—showed surprising advantage of liquid hand dishwashing detergent compositions comprising at least two different anionic surfactants and a polyethylene glycol. In one set of experiments, dishwashing detergent formulations having between about 38 and about 42 weight percent anionic surfactants comprising both a secondary alkane sulfonate and an alkyl ether sulfate in approximately equal proportions, and a foam stabilizing surfactant such as amine oxide or coco amidopropyl betaine were tested with polyethylene glycols of increasing molecular weight. It was found that the addition of polyethylene glycols having a molecular weight ranging between about 400 to about 800 exhibited significant improvement in performance as measured by the well-known Mini Plate test in water having a hardness of about 150 ppm. At the 150 ppm level of hardness, the performance of formulations with polyethylene glycol having a molecular weight ranging from 400 to 800, improved between 20 and 40 percent over formulations having no polyethylene glycol or having similar concentrations of polyethylene glycol with a molecular weight greater than 800. At hardness levels of about 300 ppm, adding polyethylene glycol resulted in a similar relative benefit over the 400 to 800 polyethylene glycol molecular weight range, but at a relatively reduced level.

The unexpected resilient foaming properties of the formulations of the invention—as measured by the Mini-plate test—are illustrated in the following examples. It was also determined that flash foam production was not a reliable predictor of the Mini-plate detergent performance.

Foam production, often called flash foaming, of the formulations in the following examples was measured by methods well-known in the detergent art. A 100 ml sample of each formulation at the indicated dilution level was placed in a 500 ml graduated cylinder at ambient conditions including a room temperature of about 25° C. Samples were uniformly shaken and the resulting foam was measured according to the volume of the foam which appeared above the 100 ml level in the graduated cylinder.

The detergency performance effectiveness of each formulation was measured by the well-known "Miniplate" method wherein a series of soiled miniature plates (hard surface) are washed in a serial fashion with a brush in solutions of the hand dishwashing samples under standard conditions until the distinguishable and reproducible disappearance of the foam is reached. The standard conditions included a room temperature of about 25° C. The number of mini-plates washed is compared to a commercial standard. The mini-plates are soiled with a partially hydrogenated vegetable oil, available from Procter and Gamble Company under the trade name, Crisco, which was dyed red.

EXAMPLES

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

Example I

Formulations comprising at least two anionic surfactants were prepared and detergency performance—as measured by the number of mini-plates washed—was evaluated. In formulations A–F, a first anionic surfactant comprised a secondary sodium alkane sulfonate and the co-anionic surfactant comprised an alkyl ether sulfate. All of these blends contained 37.5 weight percent total surfactant and contained a ratio of sulfonate to sulfate of about 0.875. Formulations A–F included coco amidopropyl betaine as a foam stabilizing surfactant, and ethanol as a hydrotrope as shown in Table 1. Formulation B–F comprised polyethylene glycol (PEG) components at a level of about 3.8 wt-% (about 10 percent of total surfactant) over a molecular weight range from about 400 to about 1500. Foam production as measured in a rotating cylinder test in water hardness of 150 ppm showed improvement over the base formulation A for the addition of polyethylene glycol over the full range of molecular weight. However, the foam production in water having a hardness of 300 ppm indicated little or no improvement over the molecular weight range of polyethylene glycol addition in formulations B–F. As shown in Table 1, and according to the well-known mini-plate test, the observed number of mini-plates washed in water having a hardness of either 150 ppm or 300 ppm, all of the formulations which included polyethylene glycol or PEG (See columns B–F) exhibited significantly increased detergency performance in the presence of oily soil. The most significant increase in Miniplate washing performance occurred in formulation C, when the molecular weight of the polyethylene glycol was about 600. This enhanced performance extended above a 600 molecular weight up to about 1000 molecular weight, and then dropped off as the molecular weight of the polyethylene glycol approached 1500. The enhanced detergency performance also extended below the molecular weight value of 600 to about 400. The detergency performance of the formulations of the present invention is shown in comparison to the performance of a base blend A, which contains no PEG. This trend in detergency performance with PEG addition as measured by foam persistence was indicated by foam generation results in 150 ppm hardness water but was not indicated by the foam production results in water with the hardness of 300 ppm.

Example II

Formulation G represented a formulation that included at least two anionic surfactants, coco amidopropyl betaine and ethanol (hydrotrope). The ratio of the three surfactants—the two anionic surfactants and the foam stabilizing surfactant—was maintained at the level of systems A–F while the total surfactant was increased by 3.8 percent corresponding to the level of PEG added in systems B–F. This case can be compared with cases B–E and clearly shows that without the PEG (400–1000 MW) component, increasing the amount of total surfactant does not achieve the benefits of the blends containing PEG and actually reduced the detergency performance at 150 ppm water compared to the base blend, in case A, even though the foam forming tests indicated that there was a foam production benefit.

Example III

Formulations H–J, E represented a series of formulations wherein at least two anionic surfactants, coco amidopropyl betaine, ethanol (hydrotrope) and the content of 600 molecular weight PEG is increased from 0.5 to 3.8 weight percent. This series (H–J, E) can be compared with case A, which contains no PEG, and clearly showed that the addition of 0.5 percent of PEG provides an increase in detergency performance (Mini-plate) at the higher water hardness while at higher PEG levels (1 to 3.8 percent) there is a more substantial increase in detergency performance shown by the Mini-plate tests—especially in the water with the greater amount of hardness—compared to the base blend, A. Conversely, no benefits are indicated in the foam production at the hardness of 300 ppm, and the foam production at the 150 ppm level showed a reduction in benefit with increasing addition of PEG of a 600 molecular weight.

Example IV

Another series of formulations (K–M) shown in Table 2 was developed wherein the formulations included a first anionic surfactant, secondary sodium alkane sulfonate and a second or co-anionic surfactant, alkyl ether sulfate, with increasing amounts of PEG. These systems did not include any additional surfactant. Formulation K represents a revised base level without PEG and with the alkane sulfonate and alcohol ether sulfate surfactants. From formulation K as the new base blend, increasing amounts of a nominally 600 molecular weight PEG were added at a level of 3.8 wt-% in formulation L and at a level of 5.0 in formulation M, with the surprising result that the detergency performance shown by the Mini-plate test at low hardness improved only slightly, while the detergency performance at the higher hardness value of 300 ppm, increased significantly over the blend K containing no PEG. The corresponding foam production tests showed no improvement for the PEG addition in formulations L and M.

Example V

Formulations N–O shown in Table 2 represented a series of comparative formulations wherein only one anionic surfactant, alkyl ether sulfate, was employed with ethanol, and coco amidopropyl betaine,. Formulation O represented the same formula as N but contained 3.8 wt-% of 600 molecular weight PEG. In this series (N–O), formulation N (no PEG) can be compared with formulation O (3.8 percent PEG) and clearly showed that the addition of PEG at a level of 3.8 wt-% resulted in a reduction in Mini-plate detergency performance when only a single anionic surfactant was present. The foam production in formulation O results were mixed with the foam production for the 150 ppm water hardness improving slightly, while the foam production for the 300 ppm hardness decreased relative to formulation N.

Example VI

Formulations P–Q and R–S shown in Table 2 represented a series of comparative formulations wherein the total amount of surfactant was reduced to 10 weight percent and 20 weight percent, respectively. Formulations P–Q showed that there was no apparent advantage of adding 3.8 percent PEG to a formulation having only 10 percent total surfactant, even though the ratio of the three surfactants was the same as case A. Foam production in formulations P and Q showed little advantage of the PEG addition at this level of total surfactant. Formulations R–S showed that there was a significant advantage in Mini-plate detergency performance when the total surfactant amount was about 20 weight percent in water having a hardness of 150 ppm, while the increase in detergency performance at a hardness of 300 ppm was only slight. Foam production in formulation R was only slightly improved over formulation S.

Example VII

Formulations T–V shown in Table 3 represented a series of comparative formulations wherein the two anionic surfactants included secondary sodium alkane sulfonate and alpha olefin sulfonate together with amine oxide and magnesium sulfate. PEG is present in formulation U at 2 wt-% and in formulation V at 3 wt-%. There is no alcohol included. In this series (T–V), the total amount of surfactant was about 42 wt-%. Both formulations U and V showed significant detergency performance improvement over formulation T, demonstrating the unexpected performance benefit provided by the addition of PEG to a two anionic surfactant system. Conversely, the foam production results showed a decreased foam production for increasing PEG addition relative to formulation T, although there was a slight improvement in foam production in formulation V relative to formulation T, at the 300 ppm water hardness level.

Example VIII

Formulations W–Z shown in Table 3 represented a series of comparative formulations wherein only one anionic surfactant, secondary sodium alkane sulfonate, is present together with the foam stabilizing surfactant amine oxide at a total surfactant level of 42 wt-%. PEG is present in cases X–Z in increasing amounts of 2, 3.8 and 5.0 wt-%. in cases X, Y and Z, respectively. In cases X–Z, detergency performance decreased with increasing PEG in the formulation. Foam production results did not show any significant benefit for the PEG addition. This once again demonstrated the need for at least two anionic surfactants to achieve the performance enhancement unexpectedly provided by the PEG.

Example IX

Formulations AA–CC shown in Table 3 represented a series of comparative formulations which are similar to formulations A, J, and C wherein the inorganic salt, magnesium sulfate, is present at a level of about 2 wt-% and ethanol is absent. PEG is present in cases BB- and CC in increasing amounts of 2, 3.8 wt-%, in cases BB and CC, respectively. In cases BB and CC, detergency performance showed an advantage with increasing PEG in the formulations. Foam production in formulations BB and CC showed significant improvement relative to formulation AA.

TABLE 1

DETERGENT BLENDS COMPARATIVE RESULTS

| Formulation | A | B | C | D | E | F | G | H | I | J |
|---|---|---|---|---|---|---|---|---|---|---|
| Secondary Sodium Alkane Sulfonate | 15.4 | 15.4 | 15.4 | 15.4 | 15.4 | 15.4 | 16.9 | 15.4 | 15.4 | 15.4 |
| Alkyl Ether Sulfate | 17.6 | 17.6 | 17.6 | 17.6 | 17.6 | 17.6 | 19.4 | 17.6 | 17.6 | 17.6 |
| Coco amidopropyl betaine | 4.5 | 4.5 | 4.5 | 4.5 | 4.5 | 4.5 | 5.0 | 4.5 | 4.5 | 4.5 |
| Polyethylene Glycol 400 | | 3.8 | | | | | | | | |
| Polyethylene Glycol 600 | | | 3.8 | | | | | 0.5 | 1.0 | 2.0 |
| Polyethylene Glycol 800 | | | | 3.8 | | | | | | |
| Polyethylene Glycol 1000 | | | | | 3.8 | | | | | |
| Polyethylene Glycol 1500 | | | | | | 3.8 | | | | |
| Ethanol | 3.81 | 3.81 | 3.81 | 3.81 | 3.81 | 3.81 | 4.2 | 3.81 | 3.81 | 3.81 |
| Water | Bal | Bal | Bal | Bal | Bal | Bal | Bal | Bal | Bal | Bal |
| TOTAL SURFACTANT | 37.5 | 37.5 | 37.5 | 37.5 | 37.5 | 37.5 | 37.5 | 37.5 | 37 | 37 |
| Rotating Cylinder (mL Foam @ 150 ppm) | 241 | 310 | 368 | 313 | 304 | 310 | 288 | 288 | 275 | 285 |
| Rotating Cylinder (mL Foam @ 300 ppm) | 220 | 220 | 217 | 177 | 208 | 206 | 256 | 174 | 207 | 222 |
| Mini-Plate (# Plates Washed @ 150 ppm) | 72 | 87 | 99 | 93 | 72 | 63 | 66 | 69 | 72 | 87 |
| Mini-Plate (# Plates Washed @ 300 ppm) | 51 | 57 | 72 | 66 | 66 | 48 | 57 | 57 | 63 | 78 |

TABLE 2

DETERGENT BLENDS COMPARATIVE RESULTS

| Formulation | A | K | L | M | N | O | P | Q | R | S |
|---|---|---|---|---|---|---|---|---|---|---|
| Secondary Sodium Alkane Sulfonate | 15.4 | 17.5 | 17.5 | 17.5 | | | 4.1 | 4.1 | 8.2 | 8.2 |
| Alkyl Ether Sulfate | 17.6 | 17.6 | 17.6 | 17.6 | 33.0 | 33.0 | 4.7 | 4.7 | 9.4 | 9.4 |
| Coco amidopropyl betaine | 4.5 | | | | 4.5 | 4.5 | 1.2 | 1.2 | 2.4 | 2.4 |
| Polyethylene Glycol 400 | | | | | | | | | | |
| Polyethylene Glycol 600 | | | 3.8 | 5.0 | | 3.8 | 3.8 | | 3.8 | |
| Polyethylene Glycol 800 | | | | | | | | | | |
| Polyethylene Glycol 1000 | | | | | | | | | | |
| Polyethylene Glycol 1500 | | | | | | | | | | |
| Ethanol | 3.81 | 4.3 | 4.3 | 4.3 | 7.10 | 7.10 | 1.01 | 1.01 | 1.22 | 1.22 |
| Water | Bal | Bal | Bal | Bal | Bal | Bal | Bal | Bal | Bal | Bal |

TABLE 2-continued

DETERGENT BLENDS COMPARATIVE RESULTS

| Formulation | A | K | L | M | N | O | P | Q | R | S |
|---|---|---|---|---|---|---|---|---|---|---|
| TOTAL SURFACTANT | 37.5 | 37.5 | 37.5 | 37.5 | 37.5 | 37.5 | 10.0 | 10.0 | 20.0 | 20.0 |
| Rotating Cylinder (mL Foam @ 150 ppm) | 241 | 378 | 325 | 418 | 329 | 355 | 107 | 84 | 158 | 153 |
| Rotating Cylinder mL Foam @ 300 ppm) | 220 | 215 | 221 | 196 | 313 | 245 | 75 | 73 | 129 | 118 |
| Mini-Plate (# Plates Washed @ 150 ppm) | 72 | 63 | 60 | 66 | 84 | 72 | 15 | 15 | 32.5 | 20 |
| Mini-Plate (# Plates Washed @ 300 ppm) | 51 | 33 | 51 | 57 | 69 | 60 | 12 | 12 | 15 | 12 |

TABLE 3

DETERGENT BLENDS COMPARATIVE RESULTS

| Formulation | T | U | V | W | X | Y | Z | AA | BB | CC |
|---|---|---|---|---|---|---|---|---|---|---|
| Secondary Sodium Alkane Sulfonate | 11.0 | 11.0 | 11.0 | 31.0 | 31.0 | 31.0 | 31.0 | 15.4 | 15.4 | 15.4 |
| Alpha Olefin Sulfanate | 20.0 | 20.0 | 20.0 | | | | | 17.6 | 17.6 | 17.6 |
| Amine Oxide | 11.0 | 11.0 | 11.0 | 11.0 | 11.0 | 11.0 | 11.0 | | | |
| Coco amidopropyl betaine | — | — | — | — | — | — | — | 4.5 | 4.5 | 4.5 |
| Magnesium Sulfate | 5.2 | 5.3 | 5.4 | | | | | 2.0 | 2.0 | 2.0 |
| Polyethylene Glycol 600 | 0 | 2 | 3 | | 2.0 | 3.8 | 5.0 | | 2.0 | 3.8 |
| Water | Bal | Bal | Bal | Bal | Bal | Bal | Bal | Bal | Bal | Bal |
| Total Surfactant | 42 | 42 | 42 | 42 | 42 | 42 | 42 | 42 | 42 | 42 |
| Rotating Cylinder (mL Foam @ 150) | 340 | 299 | 333 | 348 | 328 | 324 | 367 | 265 | 289 | 329 |
| Rotating Cylinder (mL Foam @ 300) | 153 | 132 | 190 | 318 | 334 | 273 | 301 | 197 | 204 | 230 |
| Mini-Plate (# Plates Washed @ 150 ppm) | 57 | 72 | 75 | 84 | 51 | 75 | 72 | 54 | 69 | 69 |
| Mini-Plate (# Plates Washed @ 300 ppm) | 36 | 57 | 63 | 63 | 39 | 66 | 57 | 51 | 60 | 54 |

I claim:

1. A dishwashing detergent composition consists of an anionic surfactant mixture containing at least two different anionic surfactants, a polyethylene glycol, water, and a phase stabilizer selected from the group consisting of a hydrotrope, an inorganic salt, a foam stabilizing surfactant, and mixtures thereof, wherein said dishwashing detergent composition is essentially free of alkyl polyglucoside surfactants and the polyethylene glycol having a molecular weight ranging from about 400 to about 1000 comprises from about 0.5 to 10 weight percent of the dishwashing detergent.

2. The dishwashing detergent of claim 1 wherein the anionic surfactant mixture comprising at least two different surfactants are selected from the group consisting of an alkane sulfonate, an alkyl benzene sulfonate, an alpha olefin sulfonate, an alkyl sulfate, an alkyl ether sulfate, an alkyl ester sulfonate, and mixtures thereof.

3. The dishwashing detergent of claim 1 wherein the inorganic salt is selected from the group consisting of magnesium chloride, magnesium sulfate, and mixtures thereof.

4. The dishwashing detergent of claim 1 wherein the hydrotrope is selected from the group consisting of ethanol, isopropanol, sodium xylene sulfonate, propylene glycol, dipropylene glycol, sodium cumene sulfonate, and mixtures thereof.

5. The dishwashing detergent of claim 1 wherein the foam stabilizing surfactant is selected from the group consisting of a betaine compound, an amine oxide, an alkanolamide compound, and mixtures thereof.

6. The dishwashing detergent of claim 5 wherein the betaine compound is selected from the group consisting of coco acylamidopropyldimethyl betaine; hexadecyl dimethyl betaine; $C_{12}$–$C_{14}$ acylamidopropylbetaine; $C_{12}$–$C_{18}$ acylamidohexyldiethyl betaine; 4-($C_{14}$–$C_{16}$ acylmethylamidodiethylammonio)-1-carboxybutane; $C_{13}$–$C_{18}$ acylamidodimethylbetaine; $C_{12}$–$C_{18}$ acylamidopentanediethyl-betaine; $C_{12}$–$C_{16}$ acylmethylamidodimethylbetaine, coco amidopropyl betaine, and mixtures thereof.

7. The dishwashing detergent of claim 1 wherein the anionic mixture comprises a first anionic surfactant comprised of an alkyl sulfonate and a second anionic surfactant selected from the group consisting of alpha olefin sulfonate, alkyl ether sulfate, alkyl sulfate, alkyl benzene sulfonate, alkyl ester sulfonate, and mixtures thereof.

8. The dishwashing detergent of claim 7 wherein the anionic surfactant mixture comprises 6–30 wt-% of a first surfactant and 6–30 wt-% of a second anionic surfactant.

9. The dishwashing detergent of claim 1 wherein the polyethylene glycol comprises a molecular weight from about 400 to about 800.

10. The dishwashing detergent of claim 1 wherein the polyethylene glycol comprises a molecular weight from about 400 to about 600.

11. The dishwashing detergent of claim 7 wherein a ratio of the first anionic surfactant to the second anionic surfactant ranges from about 5:1 to 1:5.

12. The dishwashing detergent of claim 1 wherein a total surfactant level ranges from about 15 to about 60 weight percent.

13. The dishwashing detergent of claim 1 wherein a total surfactant level ranges from about 20 to about 50 weight percent.

14. The dishwashing detergent of claim 5 wherein the amine oxide is selected from the group consisting of $C_{10}$–$C_{18}$ alkyl dimethyl amine oxides, $C_8$–$C_{12}$ alkoxy ethyl dihydroxyethyl amine oxides, alkyl amidopropyl amine oxide, and mixtures thereof.

15. The dishwashing detergent of claim 5 wherein the alkanolamide compound is selected from the group consisting of alkyl monoalkanol amide, alkyl dialkanol amide and mixtures thereof.

16. The dishwashing detergent of claim 1 wherein a ratio of the foam stabilizing surfactant to the anionic surfactant mixture comprises about 1:2 or less.

17. The dishwashing detergent of claim 7 wherein a ratio of the first anionic surfactant to the second anionic surfactant ranges from about 3:1 to 1:3.

18. The dishwashing detergent of claim 7 wherein a ratio of the first anionic surfactant to the second anionic surfactant ranges from about 1.5:1 to 1:1.5.

19. A liquid dishwashing detergent consisting of: water;

about 5 to 30% by weight of an anionic surfactant;

about 5 to 30% by weight of a co-anionic surfactant;

about 0.5 to 10% by weight of polyethylene glycol;

about 0 to 15% by weight of a foam stabilizing surfactant; and, about 0 to 15% by weight of optional ingredients;

wherein the polyethylene glycol has a molecular weight ranging from about 400 to about 1000.

20. The liquid dishwashing detergent of claim 19 wherein the anionic surfactant comprises an alkyl sulfonate and the co-anionic surfactant is selected from the group consisting of an alpha olefin sulfonate, an alkyl ether sulfate, and mixtures thereof with the proviso that a ratio of the anionic surfactant to the co-anionic surfactant is between about 0.5 and less than 1.0.

21. The liquid dishwashing detergent of claim 19 wherein the foam stabilizing surfactant comprises a betaine compound and/or an amine oxide.

22. The dishwashing detergent of claim 19 wherein the optional ingredients are selected from the group consisting of hydrotropes, perfumes, colorants, preservatives, biocidal agents, inorganic salts, opacifiers, viscosity modifiers, and mixtures thereof.

23. A method for hand washing of a kitchen surface, comprising contacting the kitchen surface with the dishwashing detergent of claim 1.

24. A method for hand washing of a kitchen surface, comprising contacting the kitchen surface with the hand dishwashing detergent of claim 19.

* * * * *